United States Patent [19]

Watanabe et al.

[11] 4,185,262

[45] Jan. 22, 1980

[54] MAGNET DEVICE

[75] Inventors: Sadao Watanabe, Neyagawa; Mitsuru Itoh, Yawata; Tadashi Sakairi, Katano; Yasutomo Funakoshi, Sakai; Kohji Hiya, Hirakata, all of Japan

[73] Assignee: Matsushita Electric Industrial Co., Ltd., Saka, Japan

[21] Appl. No.: 928,971

[22] Filed: Jul. 28, 1978

[30] Foreign Application Priority Data

Aug. 1, 1977 [JP] Japan ..... 52-92747
Aug. 2, 1977 [JP] Japan ..... 52-93201

[51] Int. Cl.[2] ..... H01F 7/02
[52] U.S. Cl. ..... 335/302; 335/303
[58] Field of Search ..... 335/284, 302, 303, 304, 335/306

[56] References Cited

U.S. PATENT DOCUMENTS

| | | | |
|---|---|---|---|
| 3,191,106 | 6/1965 | Baermann | 335/303 X |
| 3,418,613 | 12/1968 | Trikius | 335/302 X |
| 3,942,147 | 3/1976 | Josephson | 335/303 |

*Primary Examiner*—George Harris
*Attorney, Agent, or Firm*—Stevens, Davis, Miller & Mosher

[57] ABSTRACT

A magnet device having magnetic poles of opposite polarities on the same surface comprises a plurality of plastic matix magnet elements providing a magnetic circuit arranged to concentrate the magnetic energy of the magnet elements so as to derive a great magnetic force from the magnetic poles.

12 Claims, 38 Drawing Figures

MAGNET DEVICE

BACKGROUND OF THE INVENTION

This invention relates to a magnet device including a plastic matrix magnet especially suitable for use in a magnetic roll or like devices employed in electrophotographic developing apparatus or the like.

SUMMARY OF THE INVENTION

It is an object of the present invention to provide a magnet device such as a magnetic roll having magnetic poles of opposite polarities on the same surface, in which a plurality of plastic matrix magnet elements are joined together with their axes of easy magnetization aligned substantially with the flux lines flowing between the magnetic poles so as to most efficiently derive the magnetic energy of the magnetic material.

Another object of the present invention is to provide a magnet device comprising a unique combination of plastic matrix magnet elements of given magnetic properties so as to obtain a magnetic field of most suitable length.

Still another object of the present invention is to provide a magnetic circuit which can produce a greatest possible magnetomotive force.

Yet another object of the present invention is to simplify the structure of a magnetic roll and also to simplify the structure of a magnetic circuit device including such a magnetic roll.

DESCRIPTION OF THE PREFERRED EMBODIMENTS

A plastic matrix magnet material comprises generally a mixture of a high-molecular synthetic material and a magnetic material such as powdery ferrite including at least one of barium, strontium and lead, and such a mixture is generally shaped into the form of a block in which the axes of easy magnetization (the magnetic permeable axes) of the magnetic material are oriented in a direction orthogonal with respect to the block surface under the influence of a mechanical or magnetic force.

Such a plastic matrix magnet material has magnetic properties equivalent to or better than those of an isotropic ferrite of sintered structure. For example, the residual flux density Br, coercive force $BH_c$ and maximum energy product $BH_{max}$ of such a plastic matrix magnet material are 2,100 to 2,530G, 1,850 to 2,250 $O_e$, and 1.04 to 1.49 $MGO_e$ respectively.

Figure 1A:
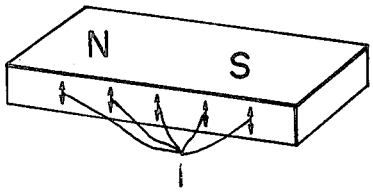
FIG. 1A PRIOR ART
FIGS. 1A, 1B and 1C are schematic perspective views showing the direction of the axes of easy magnetization in prior art plastic matrix magnets.
Figure 1B:
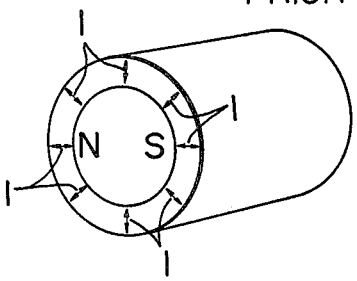
FIG. 1B PRIOR ART
Figure 1C:
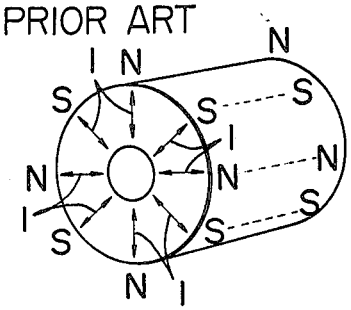
FIG. 1C PRIOR ART

FIGS. 1A, 1B and 1C show a rectangular block and cylindrical blocks obtained by shaping such a plastic matrix magnet material into the forms respectively, in which the axes of easy magnetization are oriented in the directions shown by the arrows 1, and magnetic poles of opposite polarities are provided on the same surface by means of magnetization. The maximum surface flux density of the rectangular and cylindrical plastic matrix magnets is only about 70 to 80% of that of sintered isotropic ferrite magnets of the same shape.

Figure 2A:
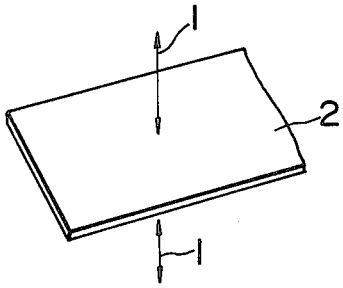
FIG. 2A is a schematic perspective view showing the direction of the axes of easy magnetization in a web of plastic matrix magnet material.
Figure 2B:
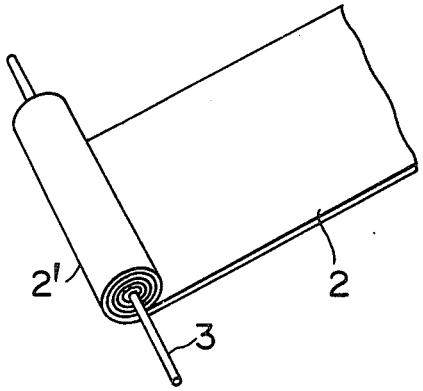
FIG. 2B is a schematic perspective view showing the web of FIG. 2A being wound around a shaft to provide a roll magnet.
Figure 3:
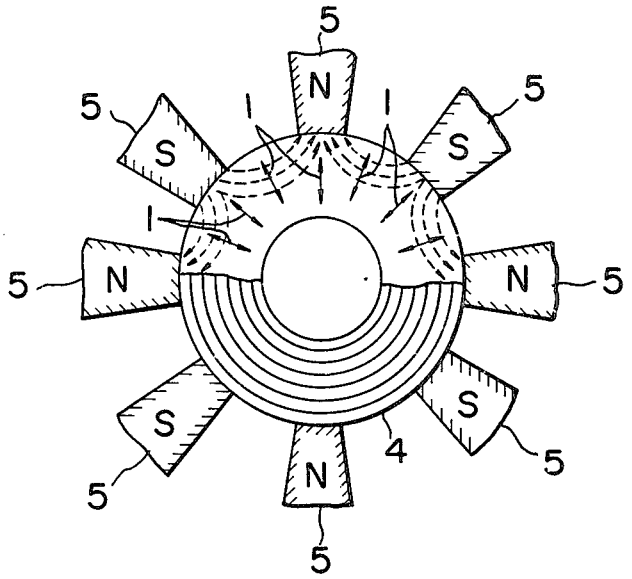
FIG. 3 is a diagrammatic view illustrating how to magnetize the roll magnet shown in FIG. 2B.

By way of example, a web 2 of plastic matrix magnet material having its axes 1 of easy magnetization oriented in a direction orthogonal with respect to its surface as shown in FIG. 2A was wound around a shaft 3 of stainless steel as shown in FIG. 2B to obtain a laminated roll magnet 2' having the axes 1 of easy magnetization oriented in its radial direction. This roll magnet 2' was then magnetized at its outer peripheral surface 4 by a magnetizing device 5 as shown in FIG. 3, and the surface flux density of the magnetized roll magnet 2′ was measured. According to the result of measurement, the maximum surface flux density of this magnet 2′ was 800 to 950G. On the other hand, a sintered isotropic ferrite magnet of the same shape had a maximum surface flux density of 1,000G.

Figure 4:
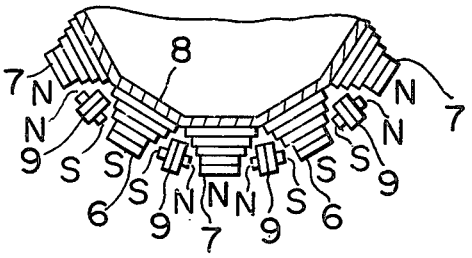
FIG. 4 PRIOR ART
FIG.4 is a schematic sectional view of part of a prior art magnet device.

In an effort to increase the surface flux density of such a magnet, a magnet device having a structure as shown in FIG. 4 has been developed. This magnet device is constructed by laminating a plurality of magnet pieces. Referring to FIG. 4, magnets 6 and 7 having magnetic poles S and N are mounted on a common base 8 of soft magnetic material to form closed magnetic paths, and magnets 9 having a magnetic axis oriented in a direction orthogonal with respect to the magnetic axis of the magnets 6 and 7 are disposed to prevent leakage of magnetic flux from the side surfaces of the associated magnets 6 and 7.

The term "magnetic axis" is used in the above description to indicate the direction of magnetization of the N and S poles of the magnetized magnets. Thus, each magnet 9 interposed between the associated magnets 6 and 7 is magnetized to have its N and S poles disposed opposite to the S and N poles of the magnets 6 and 7 respectively. This magnet arrangement has been found defective in that the magnets 9 tend to be upset by the repulsive force of the magnets 6 and 7 making it difficult to mount them in proper position. Further, the necessity for the provision of the common base 8 of soft magnetic material for forming the closed magnetic paths has resulted in an increase in the number of parts. Furthermore, the proposed magnet device has been defective in that, in spite of the interposition of each magnet 9 in the gap between the associated magnets 6 and 7 for preventing leakage of magnetic flux due to the presence of the gap, this gap cannot still be completely filled resulting in the appearance of leakage flux.

The present invention is designed to obviate such prior art defects. The magnet device according to the present invention utilizes such properties of the plastic matrix magnet material that it can be easily cut by a cutter such as a knife, it is sufficiently flexible and freely bent to be shaped into any desired form, and it can be easily bonded to another by heat, pressure, an adhesive or the like. The plastic matrix magnet material is rolled into the form of a roll magnet to substantially eliminate the gap between it and a spacer thereby obviating an undesirable reduction of the permeability and losses due to the leakage of magnetic flux.

Figure 5:
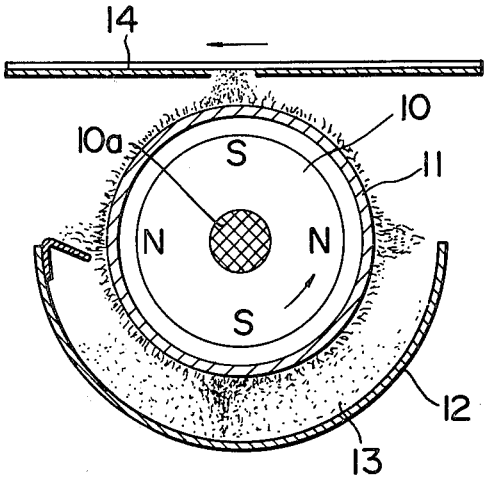
FIG. 5 is a schematic vertical sectional view of part of an electrophotographic developing apparatus.

The magnet device according to the present invention finds useful application in, for example, an electrophotographic developing apparatus as shown in FIG. 5. Referring to FIG. 5, the apparatus comprises a cylindrical magnet 10 magnetized alternately at opposite polarities in its circumferential direction, a rotary shaft 10*a* coupled integrally to this cylindrical magnet 10, a sleeve 11 supported in coaxial relation with the magnet 10 while defining a suitable gap between its inner peripheral surface and the outer peripheral surface of the magnet 10, a container 12 containing a toner 12, and a toner-image receiving sheet 14. The sleeve 11 is made of a non-magnetic material or weak magnetic material such as aluminum, a synthetic resin or 18-8 stainless steel.

Figure 6:
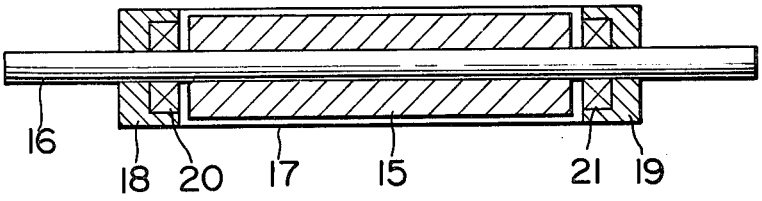
FIG. 6 is a schematic sectional view of the magnetic roll used in the apparatus shown in FIG. 5.

FIG. 6 shows in detail the arrangement of the cylindrical magnet 10, rotary shaft 10*a* and sleeve 11 among the elements shown in FIG. 5. In FIG. 6, the numerals 15, 16 and 17 designate the magnet, shaft and sleeve respectively, and 18, 19 and 20, 21 designate flanges and bearings respectively.

In the magnetic roll 2′ described hereinbefore, a web 2 of plastic matrix magnet material having its axes 1 of easy magnetization oriented in the direction orthogonal with respect to its surface as shown in FIG. 2A is wound around a shaft 3 of stainless steel as shown in FIG. 2B, so that the roll 2′ has the axes 1 of easy magnetization oriented in its radial direction.

Figure 7:
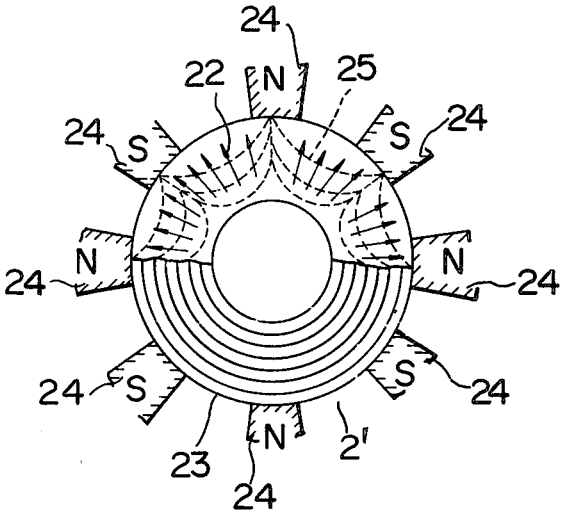
FIG. 7 is a diagrammatic view illustrating the magnetic circuit in the roll magnet shown in FIG. 2B.

In the magnetic roll 2′ thus obtained, the axes 22 of easy magnetization are oriented in the radial direction as shown in FIG. 7. A magnetizing device 24 is brought into contact with the outer peripheral surface 23 of this magnetic roll 2′, and energizing current is supplied to the magnetizing device 24 to produce flux lines 25 within the magnetic roll 2′. The maximum surface flux density of the magnetized magnetic roll 2′ was measured by bringing a Hall element into contact with the outer peripheral surface 23 of the magnetic roll 2′. According to the result of measurement, the maximum surface flux density was 850 to 950G.

The residual flux density Br, coercive force BHc and maximum energy product $BH_{max}$ of the plastic matrix magnet material were 2,170 to 2,430G, 1,900 to 1,990 $O_e$, and 1.11 to 1.39 $MGO_e$ respectively.

Preferred embodiments of the present invention will now be described in detail with reference to the drawings.

EMBODIMENT 1

A mixture consisting of 6% by weight of chlorinated polyethylene, 5.9% by weight of a plasticizer, 0.1% by weight of a lubricant and 88% by weight of ferrite were stirred for 5 minutes in a Henschel mixer rotating at 1,500 rpm, and the paste thus obtained was then treated for 5 to 10 minutes in a roll mill at 90° to 130° C. Finally, the paste was shaped into the form of a web 27 having a thickness of 0.5 to 1.2 mm. In this web 27, the axes 26 of easy magnetization of the ferrite grains of substantially domain size were oriented in a direction orthogonal with respect to the web surface. The residual flux density Br, coercive force BHc and maximum energy product $BH_{max}$ of this web 27 were 2,430 G, 1,880 $O_e$ and 1.39 $MGO_e$ respectively.

Figure 8:
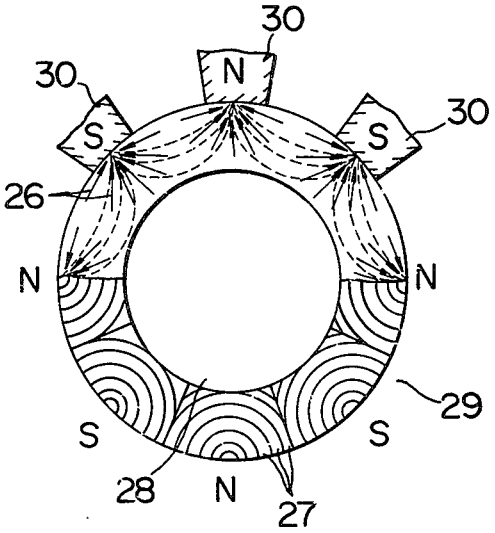
FIG. 8 is a diagrammatic view illustrating the structure of an embodiment of the magnet device according to the present invention.

This web 27 was cut into eight groups each including six strip-like plastic matrix magnet elements 27 having respectively different widths of 3.5, 5.5, 9.0, 11.5, 13.5 and 15.5 mm, a thickness of 0.9 to 1.0 mm and a length of 300 mm. The strip-like plastic matrix magnet elements 27 in each group were combined together into a block of substantially semi-circular cross section as shown in FIG. 8. Eight blocks of such a configuration were disposed around a shaft 18 of stainless steel having a diameter of 18 mm as shown in FIG. 8 and were compressed in the radial direction by a hydrostatic pressure to obtain a magnetic roll 29 as shown in FIG. 8. The magnetic roll 29 was then magnetized by a magnetizing device 30 disposed as shown in FIG. 8. The maximum flux density at the outer peripheral surface of the magnetized magnetic roll 29 was 1,300 to 1,350 G.

EMBODIMENT 2

Figure 9A:
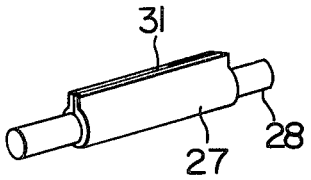
FIGS. 9A, 9B and 9C are schematic perspective views showing a process for the manufacture of another embodiment of the magnet device according to the present invention.
Figure 9B:
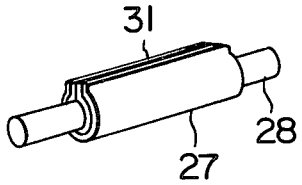
Figure 9C:
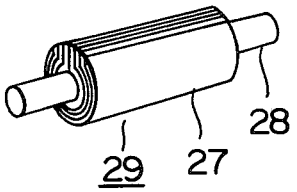
Figure 10:
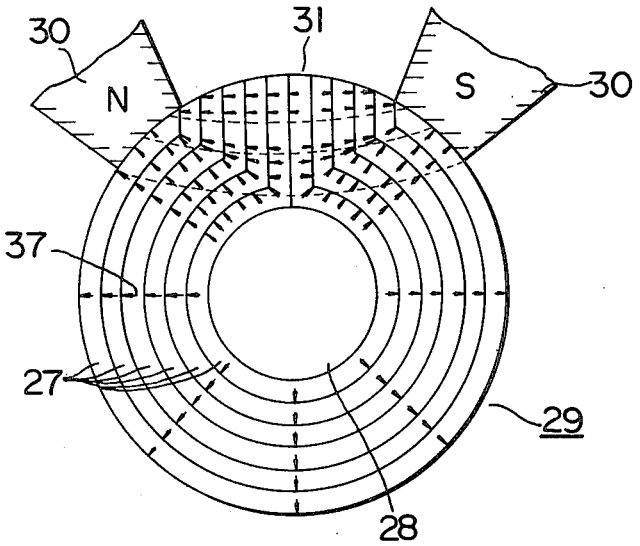
FIG. 10 is a diagrammatic view illustrating the magnetic circuit in the magnet device shown in FIG. 9C.

A mixture similar to that used in Embodiment 1 was similarly turned into the form of a paste to obtain a web 27 having the axes of easy magnetization oriented in the direction orthogonal with respect to its surface. This web 27 was similarly cut into strip-like plastic matrix magnet elements 27. A first magnet element 27 was wound around a shaft 28 having a diameter of 7 mm as shown in FIG. 9A. After applying a chloroprene adhesive on the outer surface of the first magnet element 27, a second magnet element 27 was laminated on the first magnet element 27 as shown in FIG. 9B. After laminating a plurality of such magnet elements 27, a hydrostatic pressure was imparted to the outer peripheral surface of the laminate to compress the same, and then, the outer peripheral surface of the laminate was ground to obtain a magnetic roll 29 having a diameter of 19 mm, the final shape of which is shown in FIG. 9C. FIG. 10 shows the section of the magnetic roll 29. A magnetizing device 30 was used to magnetize the areas of the magnetic roll 29 on the opposite sides of the butt joint 31 between the magnet elements 27. The maximum surface flux density of the magnetized magnetic roll 29 was 1,100 to 1,200 G.

EMBODIMENT 3

Figure 11A:
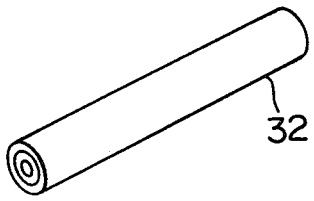
FIGS. 11A, 11B and 11C are schematic perspective views showing a process for the manufacture of still another embodiment of the magnet device according to the present invention.
Figure 11B:
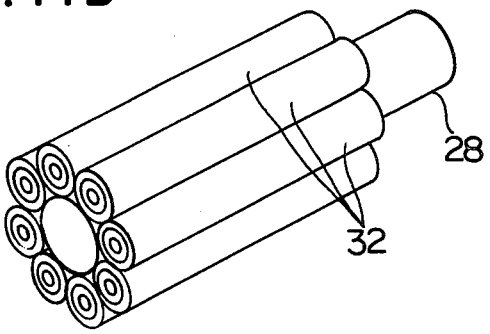
Figure 11C:
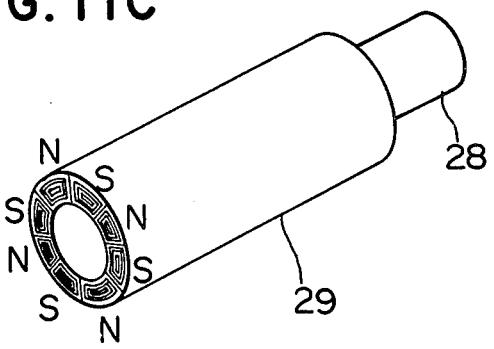

A mixture similar to that used in Embodiment 1 was similarly turned into the form of a paste to obtain a web 27 having the axes of easy magnetization oriented in the direction orthogonal with respect to its surface. This web 27 was similarly cut into strip-like plastic matrix magnet elements 27. Eight solid cylindrical samples 32 were prepared by winding each individual plastic matrix magnet element 27 into the form of a roll having an outer diameter of 12 mm as shown in FIG. 11A. These roll-shaped samples 32 were bonded to the outer peripheral surface of a shaft 28 having a diameter of 18 mm as shown in FIG. 11B, and the assembly was radially compressed by a hydrostatic pressure to obtain a magnetic roll 29 having a diameter of 29.3 mm as shown in FIG. 11C. This magnetic roll 29 was then magnetized at spaced areas as shown in FIG. 11C. The maximum surface flux density of the magnetized magnetic roll 29 was 1,200 to 1,300 G.

EMBODIMENT 4

Figure 12A:
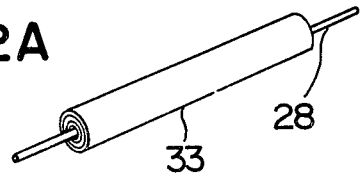
FIGS. 12A, 12B, 12C and 12D are schematic perspective views showing a process for the manufacture of a basic embodiment of the magnet device according to the present invention.
Figure 12B:
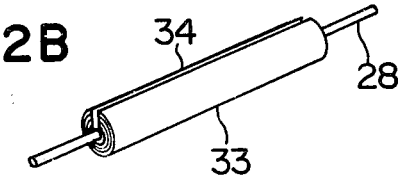
Figure 12C:
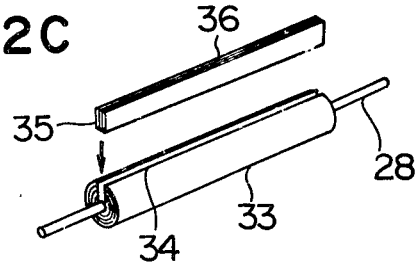
Figure 12D:
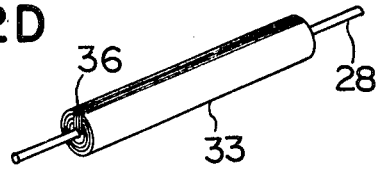

As a basic embodiment of the present invention, a strip-like plastic matrix magnet element 27 similar to that above described was wound around a shaft 28 of stainless steel to obtain a magnetic roll 33 having a diameter of 19 mm as shown in FIG. 12A. An axial groove 34 having a width of 8 mm was formed in this magnetic roll 33 to obtain a grooved magnetic roll 33 as shown in FIG. 12B. A spacer 36 as shown in FIG. 12C was formed by bonding a plurality of strip-like plastic matrix magnet elements 27 in such a manner as to have its axes 35 of easy magnetization oriented in a direction tangential with respect to the outer peripheral surface of the magnetic roll 33. Ths spacer 36 was inserted into and bonded to the groove 34 of the magnetic roll 33 to obtain an assembly as shown in FIG. 11D. The outer peripheral surface of this assembly was then ground to provide the magnetic roll 33 having its axes 37 of easy magnetization oriented as shown in FIG. 13.

Figure 13:
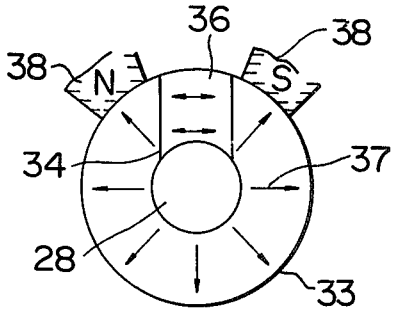
FIG. 13 is a diagrammatic view illustrating the magnetic circuit in the magnet device shown in FIG. 12D.

A magnetizing device 38 was used to magnetize the areas of the magnetic roll 33 on the opposite sides of the spacer 36 as shown in FIG. 13. The magnetized magnetic roll 33 was rotated while bringing a Hall element into contact with the outer peripheral surface thereof, and a gauss meter was used to measure the maximum surface flux density of the magnetized magnetic roll 33. The gauss meter reading was 1,050 to 1,100 G.

EMBODIMENT 5

Figure 14:
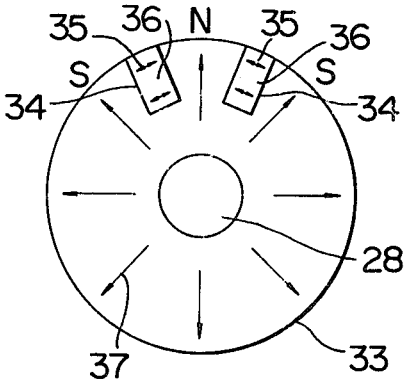
FIG. 14 is a diagrammatic view showing the magnetic circuit in a modification of the magnet device shown in FIG. 13.

A strip-like plastic matrix magnet element 27 similar to that above described was wound around a shaft 28 of stainless steel having a diameter of 7 mm to obtain a laminated roll magnet 33 having a diameter of 26.4 mm. A pair of circumferentially spaced axial grooves 34 each having a width of 3 mm and a depth of 5 mm were formed in the roll magnet 33 as shown in FIG. 14, and a spacer 36 similar to that described in Embodiment 4 was inserted into and bonded to each of the grooves 34. The roll magnet 33 was then magnetized to have an S pole, an N pole and an S pole on the left-hand side of one of the spacers 36, between the spacers 36, and on the right-hand side of the other spacer 36 respectively, to obtain a magnet device.

The maximum surface flux density of this magnet device was 1,100 to 1,150 G at the N pole sandwiched between the spacers 36 and 1,050 to 1,100 G at the S poles.

EMBODIMENT 6

A mixture having a composition as described in Embodiment 1 was stirred and pelletted in a Henschel mixer. This pellet composition was extruded from a 65-mm extruder to produce a hollow cylindrical magnet having an effective sectional area of 6.3 $cm^2$, an outer diameter of 29 mm and an inner diameter of 10 mm. A shaft having a chloroprene adhesive applied thereto is inserted into the axial bore of this cylindrical magnet, and an axial groove is formed in the outer peripheral surface of the cylindrical magnet. A strip spacer having its axes of easy magnetization oriented in a direction orthogonal with respect to its surface was inserted into the groove so that the axes of easy magnetization were oriented in a direction tangential with respect to the outer peripheral surface of the cylindrical magnet. The outer peripheral surface of the assembly was ground, and the assembly was then magnetized in a manner as described in Embodiment 4 to obtain a magnet device. The maximum surface flux density of this magnet device was 900 to 980 G.

In the cylindrical magnet obtained by extrusion, the axes of easy magnetization can be oriented in the radial direction. Thus, this cylindrical magnet exhibits the effect similar to that of the laminated roll magnet of Embodiment 4.

The plastic matrix magnet element 27 possess less magnetic energy per unit volume than that of a sintered ferrite magnet since it contains a non-magnetic material such as a high-molecular synthetic material as described hereinbefore. The magnetic properties of the plastic matrix magnet element 27 can be made equivalent to or better than those of the sintered ferrite magnet which is not especially oriented, when a strong force is applied to the plastic matrix magnet element 27 to orient the axes 37 of easy magnetization in a predetermined direction. However, the magnetic properties of the plastic matrix magnet element 27 in a direction orthogonal with respect to the oriented direction are very low. For example, the residual flux density Br and coercive force BHc of the plastic matrix magnet element 27 in such a direction are 500 to 800 G and 500 to 800 $O_e$ respectively. For the purpose of desired orientation, a very strong force must be imparted during the process of rolling or extrusion, and the direction of the axes 37 of easy magnetization is limited to a relatively simple one.- For example, the axes 37 are oriented in a direction orthogonal with respect to the strip surface or in a direction radial with respect to the center of the roll. The flux lines flowing between the magnetic poles of opposite polarities on the same surface are generally curved toward the center of the roll as shown in FIG. 7. However, in the structure shown in FIG. 7 in which the axes 22 of easy magnetization are oriented in the illustrated direction, portions of the flux lines pass in orthogonal relation with respect to the axes 22 of easy magnetization. Thus, only a small proportion of the magnetic energy of the magnetic material can be collected or utilized.

Figure 15:
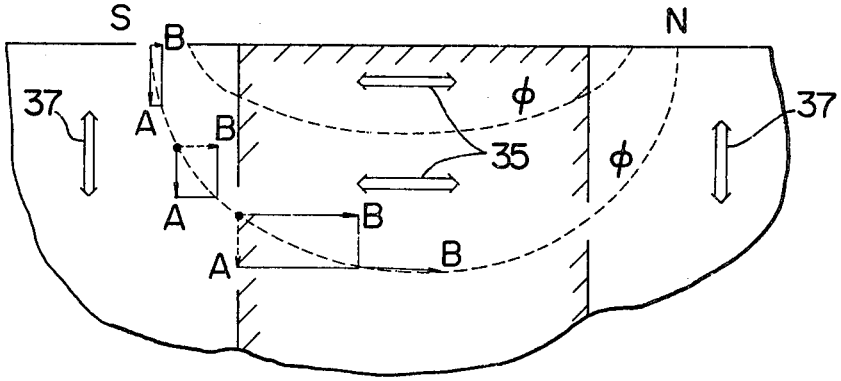
FIG. 15 is an enlarged view of part of FIG. 13 to illustrate the principle of the basic embodiment of the magnet device according to the present invention.
Figure 16A:
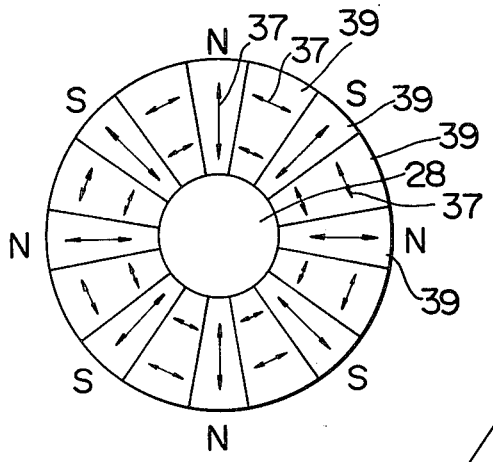
FIGS. 16A and 16B are diagrammatic views showing other embodiments of the magnet device according to the present invention based on the principle shown in FIG. 15.
Figure 17A:
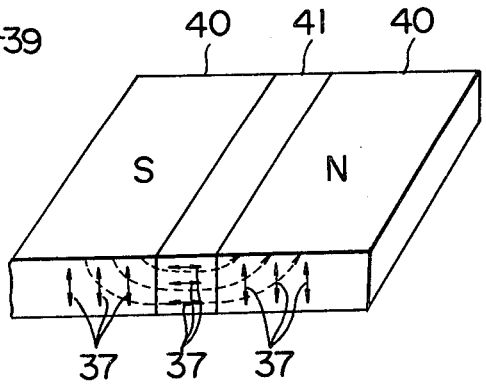
FIGS. 17A and 17B are diagrammatic views showing still other embodiments of the magnet device according to the present invention based on the principle shown in FIG. 15.
Figure 16B:
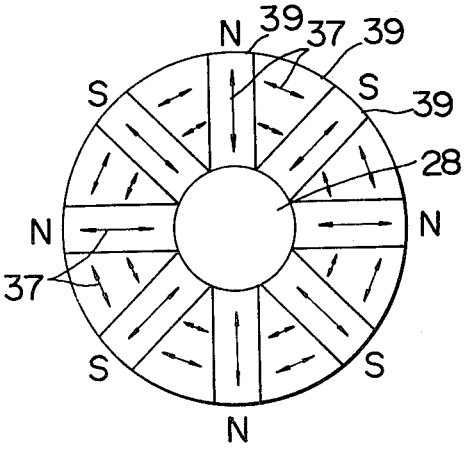
Figure 17B:
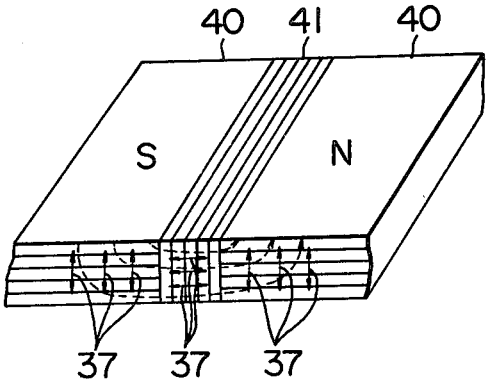

FIG. 15 is an enlarged view of part of FIG. 13 to illustrate the principle of Embodiment 4. Referring to FIG. 15, the vector of each individual portion of a flux line $\phi$ flowing between the magnetic poles S and N is divided into a first component directed toward the interior of the magnet device (that is, in a direction A) and a second component directed in a direction orthogonal with respect to the direction A (that is, in a direction B). The material having the axes 37 of easy magnetization oriented toward the interior of the magnet device is disposed in the region in which the first vector component directed in the direction A is larger than the second vector component directed in the direction B, while the material having the axes 35 of easy magnetization oriented in the direction B is disposed in the region in which the second component is larger than the first component.

On the basis of such a concept, magnet devices having the axes 37 of easy magnetization oriented as shown in FIGS. 16A, 16B, 17A and 17B can be manufactured. Further, the plastic matrix magnet elements shown in FIGS. 17A and 17B may be rolled to provide the magnet devices shown in FIGS. 16A and 16B.

Embodiments 1, 2 and 3 provide a magnetic circuit which can concentrate the magnetic energy of the magnetic material in the direction of the flux lines thereby collecting a great magnetic force at the magnetic poles. The principle will be described with reference to FIG. 18.

Figure 18:
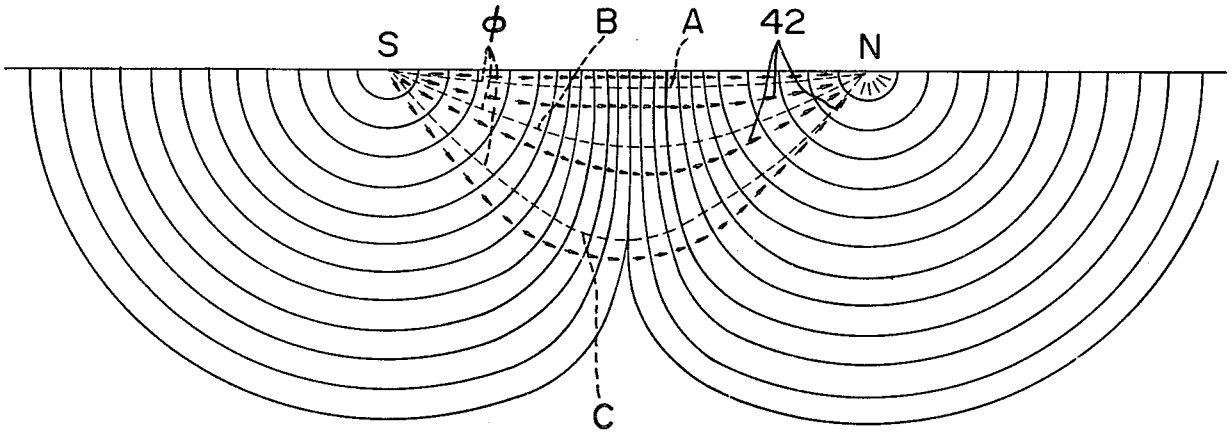
FIG. 18 illustrates another basic principle of the magnet device according to the present invention.
Figure 19:
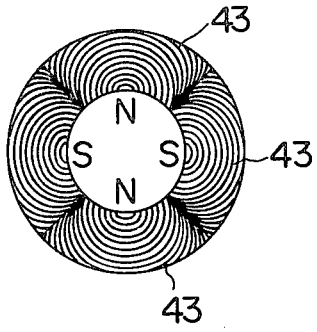
FIGS. 19, 20, 21 and 22 are schematic side elevational views of other embodiments of the magnet device according to the present invention based on the principle shown in FIG. 18.
Figure 21:
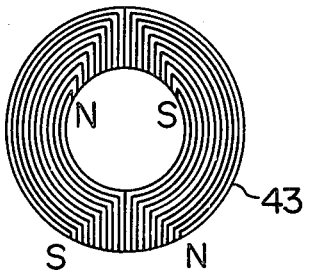
Figure 20:
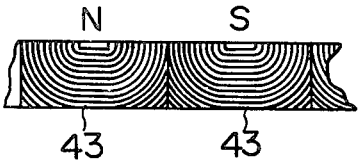
Figure 22:
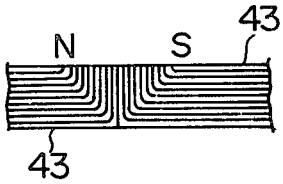

FIG. 18 illustrates a manner of magnetizing a magnet device having magnetic poles N and S of opposite polarities on the same surface. Flux lines $\phi$ flow from the magnetic pole S toward the magnetic pole N. When the magnetizing field is very weak, the flux lines $\phi$ flow along the shortest magnetic path A between the magnetic poles S and N to magnetize this area of the magnet. With an increase in the strength of the magnetizing field, the area in the vicinity of the magnetic path A is magnetically saturated, and the flux lines $\phi$ start to flow not along an inner magnetic path B, and then, along a further inner magnetic path C. Thus, although the magnetic path A in the vicinity of the magnet surface is relatively straight, the magnetic paths B and C are in the form of sharp curves having successively decreased radii of curvature. In order to derive an increased magnetic force from the magnetic poles, it is necessary to orient the axes 42 of easy magnetization of the magnetic material in the directions of the individual flux lines $\phi$.

However, it is difficult to attain alignment between the axes 42 of easy magnetization and the flux lines $\phi$ in all the areas of the unitary magnet as shown in FIG. 18. It becomes therefore necessary to obtain this ideal structure by laminating the plastic matrix magnet elements having the axes 42 of easy magnetization oriented in a predetermined direction.

According to the present invention which provides the ideal structure, the plastic matrix magnet elements having the axes 42 of easy magnetization oriented in the direction orthogonal with respect to the strip surface are substantially concentrically disposed and joined together in the region of flux flow as shown in FIG. 18 so as to provide a magnetic circuit in which the axes 42 of easy magnetization run in parallel relation with all the magnetic paths A, B and C.

Embodiments 1 and 2, that is, the magnetic rolls 29 shown in FIGS. 8 and 10 are constructed according to this principle. In the case of the magnetic rolls 29 of the illustrated structure, the maximum surface flux density can be improved by about 250 to 450 G compared with the structure shown in FIG. 7 and by about 100 to 250 G compared with the structure shown in FIG. 15, and the magnetic properties of the magnetic rolls are better than those of a sintered isotropic ferrite magnet.

The principle illustrated in FIG. 18 may be utilized to obtain various structures as shown in FIGS. 19 to 22 in which strip-like plastic matrix magnet elements 43 having the axes 42 of easy magnetization oriented in a direction orthogonal with respect to the strip surface are laminated. In FIG. 18, the structure is such that strip-like magnet elements are substantially concentrically laminated around each magnetic pole to constitute a pair of laminates of semi-circular cross section. However, it is apparent that the laminate need not necessarily be semi-circular in cross section as in Embodiment 2, and the strip-like magnet elements may be disposed substantially concentrically around the magnetic poles only in the region of passage of the flux lines between the magnetic poles so that the axes of easy magnetization can be oriented to extend in parallel with the flux lines in that region.

In Embodiments 1 and 2, strip-like magnet elements obtained by cutting a web into predetermined widths must be successively laminated. Thus, the manufacture of these structures is relatively time-consuming and troublesome. In an effort to facilitate the manufacture of the magnet device, the structure of Embodiment 3 has been conceived.

Figure 23:
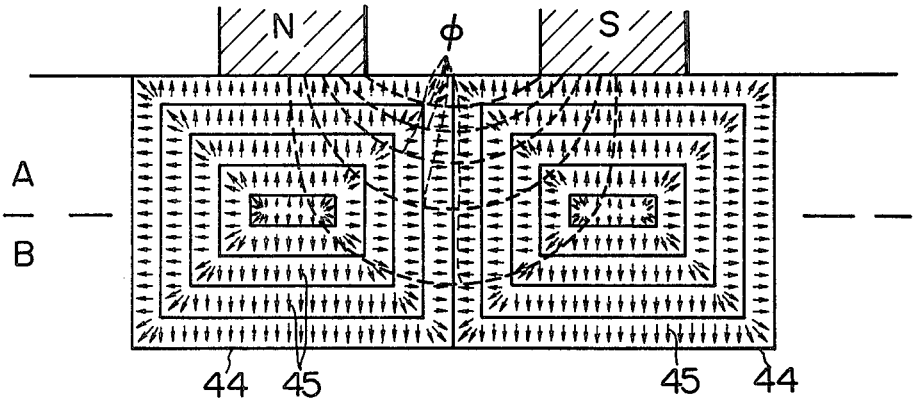
FIG. 23 illustrates still another basic principle of the magnet device according to the present invention.

The structure of the magnet device according to this second basic concept of the present invention will be described with reference to FIG. 23. Referring to FIG. 23, a pair of magnetic rolls 44 have their centers located beneath associated magnetic poles N and S, and the principle illustrated in FIG. 15 is applied to the region A defined between the surface of the magnetic rolls 44 and the line connecting the centers of the magnetic rolls 44, while the principle illustrated in FIG. 18 is applied to the region B extending inward into the magnetic rolls 44 from the line connecting the centers of the magnetic rolls 44. Thus, the axes 45 of easy magnetization are oriented in parallel with the flux lines in these two regions A and B, and the magnetic energy of the magnetic material can be effectively collected at the magnetic poles.

Figure 24:
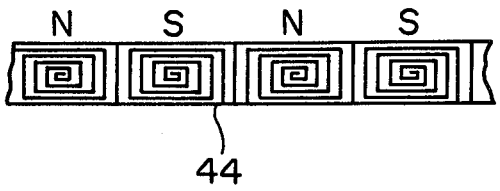
FIGS. 24, 25 and 26 are schematic side elevational views of other embodiments of the magnet device according to the present invention based on the principle shown in FIG. 23.

The principle illustrated in FIG. 23 can be utilized to provide a plastic matrix magnet device of sheet structure as shown in FIG. 24.

Figure 25:
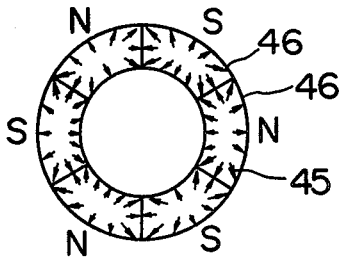
Figure 26:
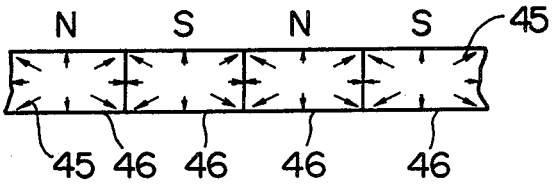

Further, in lieu of winding the strip-like magnet element into the aforementioned roll form, part-cylindrical magnet pieces 46 produced by, for example, extrusion and each having its axes 45 of easy magnetization oriented in the radial direction may be joined together to provide a plastic matrix magnet device as shown in FIG. 25, or rectangular magnet pieces 46 similarly produced and each having its axes 45 of easy magnetization oriented in the radial direction may also be joined together to provide a plastic matrix magnet device as shown in FIG. 26.

It will be understood from the foregoing detailed description of the preferred embodiments, the present invention provides the following advantages among others:

(a) The magnetomotive force can be increased to increase the maximum surface flux density at the magnetic poles.

(b) The weight of the plastic matrix magnet device can be decreased by about 27% compared with that of the sintered ferrite magnet having the same magnetomotive force. The density of the plastic matrix magnet material according to the present invention is only about 3.5 g/cm$^3$, whereas that of the sintered ferrite magnet is about 4.8 g/cm$^3$. Therefore, a magnetic roll obtained by rolling a strip of plastic matrix magnet material has a light weight which reduces wear and other gear problems by virtue of the low inertia of the magnetic roll duration rotation. Further, the light weight contributes to the reduction in the weight of copying apparatus.

(c) The plastic matrix magnet material is flexible, does not easily develop cracks and can withstand impact. In addition to the above features, the plastic matrix magnet material has the feature of being easily cut by a cutter such as a knife and the feature of being easily bonded by at least one of heat, pressure and a bonding agent. Thus, the magnetic roll of laminated structure can be easily cut into pieces which can be easily bonded together. Further, the plasticity of the magnet material can be utilized so that the plastic matrix magnet pieces of laminated structure can be integrated into a unit within a single mold by applying at least one of heat and pressure. The product thus obtained is substantially free from air gaps at the joints so that an undesirable reduction in the permeability of the magnetic circuit can be avoided, and also, losses of flux due to leakage can be eliminated. Therefore, the magnetic roll can efficiently generate the desired magnetic field.

(d) Since the magnetic roll can be easily worked as described in (c), it can be mass-produced at a very low cost.

(e) By virtue of the advantage described in (c), an axially elongated magnetic roll can be easily produced. Thus, not only a strong magnet field can appear in all the sections, but also the magnetic field can be made continuous in the axial direction.

(f) The structure of the magnet device is such that the axes of easy magnetization are oriented to extend along the flowing direction of the flux lines within the magnet device, and the magnetic paths within the magnet device form a closed loop. Therefore, a soft magnetic material like that required in the prior art is not especially required.

(g) The plastic matrix magnet device according to the present invention is magnetized after being formed into the laminated structure. This obviates the prior art troubles of attraction, repulsion or attachment of dust encountered during lamination of magnetized plastic matrix magnet elements.

We claim:

1. A magnet device having magnetic poles of opposite polarities on the same surface, comprising a plurality of shaped plastic matrix magnet elements each having its axes of easy magnetization oriented in a predetermined direction, said plastic matrix magnet elements being joined together with their centers located substantially opposite to the associated magnetic poles and with their axes of easy magnetization extending substantially in the radial direction.

2. A magnet device as claimed in claim 1, wherein said shaped plastic matrix magnet elements are joined together with their centers located opposite to the associated magnetic poles and with their axes of easy magnetization extending substantially in the radial direction.

3. A magnet device as claimed in claim 1, wherein a plurality of strip-like plastic matrix magnet elements each having its axes of easy magnetization oriented in a direction orthogonal with respect to the strip surface are concentrically arranged and bonded together to provide each of said shaped plastic matrix magnet elements which are joined together with their centers located opposite to the associated magnetic poles.

4. A magnet device as claimed in claim 1, wherein one or a plurality of strip-like plastic matrix magnet elements each having its axes of easy magnetization oriented in a direction orthogonal with respect to the strip surface are bent to have a suitable radius of curvature to be bonded together to provide each of said shaped plastic matrix magnet elements which are joined together through a butt joint between the bent surfaces, and said magnetic poles of opposite polarities are formed in the areas on the opposite sides of at least one butt joint.

5. A magnet device as claimed in claim 1, wherein an extruded plastic matrix magnet element having its axes of easy magnetization oriented in the radial direction is cut along a line passing through its center to provide each of said shaped plastic matrix magnet elements which are joined together with their centers located opposite to the associated magnetic poles.

6. A magnet device as claimed in claim 1, wherein a plurality of extruded plastic matrix magnet elements each having its axes of easy magnetization oriented in the radial direction are joined together and are cut along a line connecting the centers thereof to provide said shaped plastic matrix magnet elements which are joined together with their centers located opposite to the associated magnetic poles.

7. A magnet device as claimed in claim 2, wherein each of said shaped plastic matrix magnet elements joined together is obtained by winding, into the form of a roll, a strip-like plastic matrix magnet element having its axes of easy magnetization oriented in a direction orthogonal with respect to the strip surface.

8. A magnet device as claimed in claim 2, wherein each of said shaped plastic matrix magnet elements is an extruded plastic matrix magnet element having its axes of easy magnetization oriented in the radial direction.

9. A magnet device having magnetic poles of opposite polarities on the same surface, comprising a plurality of plastic matrix magnet elements joined together with their axes of easy magnetization extending along major components of flux line vectors each of which is divided into a major vector component and a minor vector component crossing each other in substantially orthogonal relation, whereby the axes of easy magnetization of said plastic matrix magnet elements are aligned substantially with the flux lines flowing between the magnetic poles.

10. A magnet device as claimed in claim 9, wherein a plurality of strip-like plastic matrix magnet elements each having its axes of easy magnetization oriented in a direction orthogonal with respect to the strip surface are wound into the form of a roll to provide a roll magnet, at least one axial groove being formed in said roll magnet, and a spacer in the form of a laminate of a plurality of strip-like plastic matrix magnet elements is inserted into and fixed to said groove of said roll magnet with its axes of easy magnetization extending in a direction tangential with respect to the circumference of said roll magnet.

11. A magnet device as claimed in claim 9, wherein a cylindrical plastic matrix magnet element having its axes of easy magnetization oriented in the radial direction is formed with at least one axial groove, and a spacer in the form of a laminate of a plurality of strip-like plastic matrix magnet elements is inserted into and fixed to said groove of said cylindrical plastic matrix magnet element with its axes of easy magnetization extending in a direction tangential with respect to the circumference of said cylindrical plastic matrix magnet element.

12. A magnet device as claimed in claim 9, wherein a plurality of strip-like plastic matrix magnet elements each having its axes of easy magnetization oriented in a direction orthogonal with respect to the strip surface are combined with a plurality of strip-like plastic matrix elements each having its axes of easy magnetization oriented in a direction parallel to the strip surface.

* * * * *